United States Patent [19]

Becker et al.

[11] 4,194,448

[45] Mar. 25, 1980

[54] PRINTING DEVICE ESPECIALLY FOR LABELLING APPLIANCES

[75] Inventors: Werner Becker; Kurt Schrotz, both of Hirschhorn, Fed. Rep. of Germany

[73] Assignee: Esselte Pendaflex Corporation, Garden City, N.Y.

[21] Appl. No.: 831,287

[22] Filed: Sep. 6, 1977

[30] Foreign Application Priority Data

Sep. 4, 1976 [DE] Fed. Rep. of Germany ..... 2639927

[51] Int. Cl.[2] ..... B41J 3/60; B41F 1/48; B41F 31/30

[52] U.S. Cl. ..... 101/295; 101/288; 101/324; 101/359

[58] Field of Search ..... 101/288, 291, 292, 295, 101/305, 324, 326, 348, 110, 314, 111, 359

[56] References Cited

U.S. PATENT DOCUMENTS

| | | | |
|---|---|---|---|
| 1,724,074 | 8/1929 | DuBelle | 101/110 |
| 3,786,547 | 1/1974 | O'Connor | 101/348 |
| 3,812,782 | 5/1974 | Finnahashi | 101/367 |
| 4,044,677 | 8/1977 | Hamisch | 101/348 |
| 4,068,584 | 1/1978 | Sato | 101/288 |
| 4,075,944 | 2/1978 | Conley | 101/288 |

*Primary Examiner*—William Pieprz
*Attorney, Agent, or Firm*—Gerald J. Ferguson, Jr.; Joseph J. Baker

[57] ABSTRACT

In a printing device such as labelling appliance having a printing table, a printer movably mounted with respect to the table, an ink carrier which inks printing types carried by the printer, an inking pivot member which holds the ink carrier at the free end thereof and which is pivotable against the force of a return spring, the pivot member being adapted to be pivoted out of the path of movement of the printer when the printer moves toward the printing table, the improvement comprising the ink carrier being a resilient transfer roller which is freely rotatably mounted with respect to the inking pivot member and including a dense, readily wettable surface, an inking roller that stores ink, the inking roller being made of a finely porous material, an inking roller support having side walls where each wall has an open-ended bearing recess which opens toward the transfer roller for freely rotatably supporting the inking roller about an axis parallel to the axis of rotation of the transfer roller, the inking roller support being pivotably supported by the inking pivot member about an axis which is parallel to the pivot axis of the inking pivot member, and a pressure spring for biasing the inking roller support so that the inking roller normally engages the transfer roller to ink the transfer roller upon relative rotation of the inking and transfer rollers, the inking roller being exchangeable by pivoting the inking roller support away from inking pivot member to thereby remove the inking roller out of contact with the transfer roller and thus permit the removal of the inking roller from the open-ended bearing recesses of the side walls of the inking roller support and the replacement thereof.

10 Claims, 7 Drawing Figures

PRINTING DEVICE ESPECIALLY FOR LABELLING APPLIANCES

BACKGROUND OF THE INVENTION

The invention relates to a printing device, particularly for labelling appliances having a printing table, and adjustable printer movable with respect to the printing table and an ink carrier which inks the set-up printing types and which is held by the free end of an inking pivot member and which is pivotable against the force of a return spring and which is adapted to be pivoted out of the path of movement of the printer when the printer moves towards the printing table.

Printing devices of such kind are known from German Patent Specification No. 1,224,661. In this printing device with so-called underneath inking, the inking pivot member carries an ink carrier in the form of a readily exchangeable pad of porous, resilient material. In other printing devices the ink pads are in the form of freely rotatable rollers.

The known printing devices have the disadvantage, that the ink reservoir for the pad-like ink carriers is rapidly exhausted and that the inking of the printing types is very non-uniform and dependent on the amount of ink remaining in the inking pad. When the inking pads are freshly charged, the printing types are frequently excessively wetted by the ink.

From the book printing art it is known to use a transfer roller, which accepts ink on its surface only, for the purpose of achieving uniform inking of the printing types. The ink is metered from the ink container to the transfer roller. It is known, that a hollow roller of finely porous, sintered plastic material can be used as the ink container.

The object of the present invention is to create a printing device of the kind herein before stated, in which uniform inking of the set-up printing types is assured over a long period and the ink store may be readily exchanged.

SUMMARY OF THE INVENTION

In accordance with the invention, this object is fullfilled by the ink carrier in a freely rotatable, resilient transfer roller, provided with a dense, readily wettable surface, which is associated with an inking roller which stores ink, which is made of a finely porous material and which is supported by an ink roller support for free rotation about an axis parallel to the axis of the transfer roller, the inking roller support being supported by the inking pivot member for pivoting about an axis, parallel to the axis of the inking pivot member, and held by a pressure spring which abuts against the inking pivot member so as to rest against the transfer roller by the inking roller.

In the printing device embodying the invention, the inking roller at all times rests against the transfer roller at a constant pressure, so that, during the pivoting - out movement, the transfer roller as well as the inking roller are rotated owing to the frictional connection between the printer and the two rollers, whereby new ink reaches the transfer roller from the inking roller.

Towards the outer narrow side of the labelling appliance the inking roller support is in the form of a trough-shaped protective shroud in the region of the inking roller, so that the inking cannot be inadvertently touched.

For the purpose of rapidly and readily exchanging the inking roller, the bearing eyes for the inking roller, disposed at the side walls, are open towards the transfer roller. In order to ensure that the inking roller cannot inadvertently drop out of its bearing eyes, there is provided on the inking roller support a latching projection, which prevents the inking roller support on being pivoted away but which on the application of a substantial force, enables the inking roller support to be pivoted away and then retains the latter in its pivoted-away position so that an inking roller can be exchanged for a new inking roller.

Further features of the invention are apparent from the sub-claims.

BRIEF DESCRIPTION OF THE DRAWINGS

In the following description two examplary embodiments of the inking device according to the invention will be explained in greater detail with reference to the drawings, in which.

DESCRIPTION OF PREFERRED EMBODIMENTS

Figure 1:
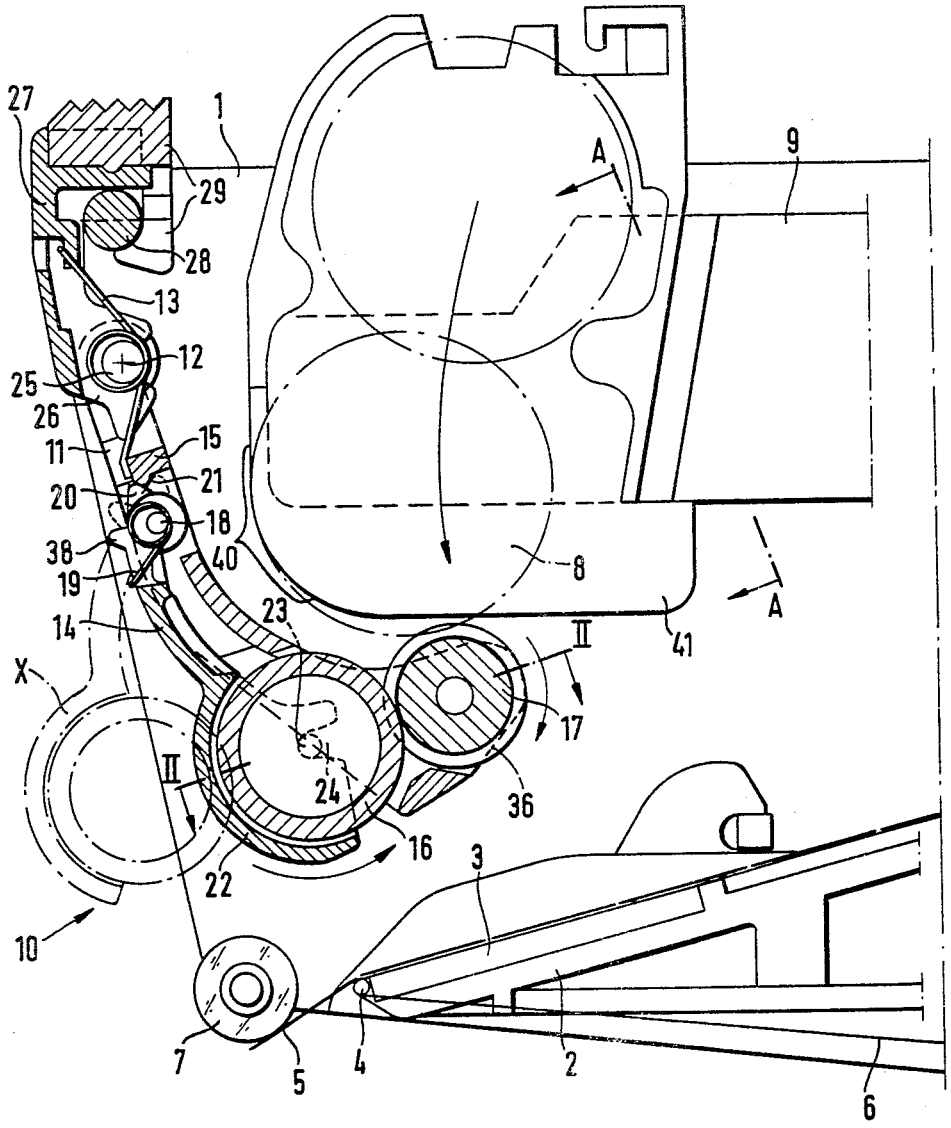
FIG. 1 is a vertical sectional view of part of a labelling appliance having a printer and an inking device.

FIG. 1 shows part of a manuably operatable labelling appliance, in whose housing 1 a printing table 2 with a resilient layer 3 is provided. At one end of the printing table 2 there is a diverting edge 4, at which a printed label 5 is detached from a supporting strip 6 which is conducted over the diverting edge 4. The label 5, whose rear margin is adhered to the supporting strip 6 or to part of the appliance and which is at its dispensing position, has its forward margin disposed underneath a pressure roller 7, by means of which it is pressed and rolled against an object to be labelled. For printing the labels 5 a printer 8 which is moveable with respect to the printing table 2 is provided, which is secured to a lever 9, supported pivotably in the appliance.

The stepwise movement of the labels 5 and the supporting strip 6 respectively is also accomplished by means of the lever 9.

In the course of every printing operation, inking device 10, which inks the set-up printing types of the printer with printing dye or ink, is pivoted out of the path of movement of the printer 8.

The inking device 10 is made up of an inking pivot member 11 which is pivotable to the left about the axis 12 against the action of a return spring 13, of an inking roller support 14 with an inking roller 16 which is freely rotatable at the end of the inking roller support which is pivotable away, and of a transfer roller 17, which is supported for free rotation at the end of the inking pivot member 11. The inking roller support 14 is supported in the inking pivot member for pivoting about an axis 18. A pressure spring 19, in the form of a leaf spring, ensures that the inking roller 16 is at all times pressed against the transfer roller 17 with a constant force. The return spring 13 as well as the pressure spring 19 each abuts by one limb against an abutment bridge 15 of the inking pivot member 11.

In the course of every printing operation, the transfer roller 17 which rests against the set-up printing type and which transfers ink from the inking roller 16 to the printing types, is rotated clockwise and at the same time urged by the printer 8 out of the path of movement of the printer 8. Simultaneously the inking roller 16 is also pivoted away without the pressure of its application being altered and rotated anti-clockwise owing to its frictional contact with the transfer roller 17, so that ink is supplied to the transfer roller 17.

For the purpose of exchanging the inking roller 16, the inking roller support 14, together with the inking roller 16 can be pivoted into the position X shown chaindotted.

A latching projection 20 initially prevents the inking roller support 14 being pivoted away, until it slides over a bead 21 upon the application of a greater degree of force. In the position X the inking roller support 14 is held by the latching projection 20, which slides over the bead 21 of the abutment bridge 15 which is resilient at least in its central region, when the inking roller support 14 is pivoted in and out. The inking roller 16 is accommodated in a protected manner within the part of the inking roller support 14 which forms a protective shroud 22, so that the person operating the labelling appliance is also prevented from inadvertently touching the inking roller 16 with his fingers. The inking roller 16 is readily exchangeable, because the bearing eyes 24, which receive the stub shafts 23 of the inking roller 16 are open towards the transfer roller 17. In this way a new inking roller 16 may also be inserted in the bearing eyes 24, without any pressure having to be exerted on this roller 16.

By means of the stub shafts 25 of the inking pivot member 11, the inking device 10 is latched in the bearing eyes 26 of a mounting bridge 27, which is held by a bolt 28, which interconnects the side walls of the labelling appliance. A latching clamp 29 which can be slid on fixes the mounting bridge 27 in its position.

Figure 2:
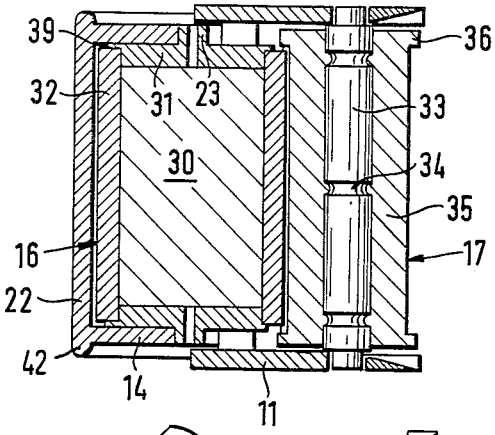
FIG. 2 is a view of the inking roller and the transfer roller on the section line II—II in FIG. 1.
Figure 3:
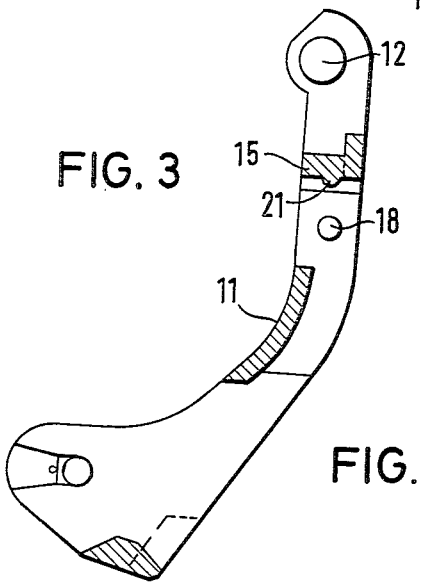
FIG. 3 is a view of the inking roller support on the section line III—III in FIG. 4.
Figure 4:
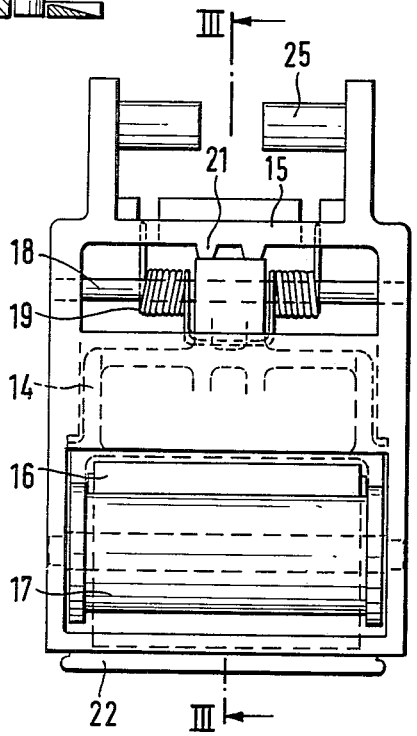
FIG. 4 is a plan view of the inking roller support with transfer roller and inking roller as seen in the direction A in FIG. 1.

FIG. 2 shows that the inking roller 16 is made up of a coarsely-porous core 30, which receives the ink, e.g. felt, of two lateral discs 31 with the stub shafts 23 made of a dense plastics material, and of an envelope of finely-porous material, which accepts and lets through the ink, in particular a relatively hard, sintered plastics material.

The transfer roller 17 consists of a metal core 33 acting as a spindel having circumferential grooves 34 worked there into and a thick envelope layer 35 of resilient material, such as rubber or polyurethane. The grooves 34 prevent axial displacement of the envelope layer 35 on the metal core 33. The envelope layer 35 has a precisely cylindrical outer surface as well as lateral shoulders 36, which embrace the margin of the felt envelope 35 of the inking roller 16. The function of the radially protruding shoulders 36 is that of rolling over the curved track 40 of the lateral housing walls 41 of the printer 8 in the course of the printing operation, so that in the course of each printing operation the transfer roller 17 is rotated for approximately 360 degree. The larger inking roller 16 rotating through an angle depending on the ratio of the circumferences of the inking roller 16 and the transfer roller 17. As the inking roller 16 rolls over the transfer roller 17, not only is ink uniformly applied to the circumference of the transfer roller 17, but also local accumulations of ink are adsorbed by the inking roller 16.

The disks 31 are pressed into the hollow cylinder of the finely - porous envelope 32. Radially protruding shoulders 39, which extend over approximately half the thickness of the envelope 32, are provided on the outer side of the disks 31. In this way the coarsely-porous core 30 is prevented from being squashed.

Figure 5:
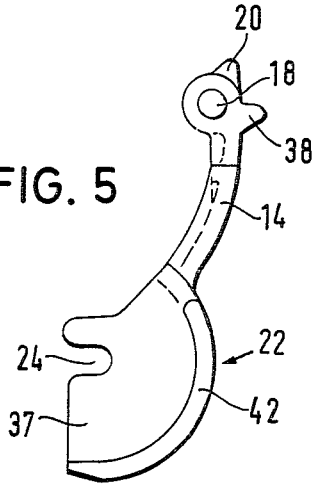
FIG. 5 is a side view.
Figure 6:
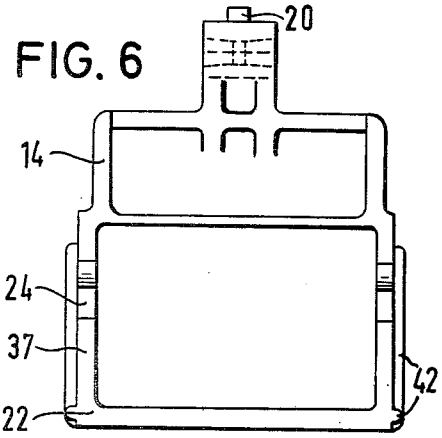
FIG. 6 is a plan view of the inking roller support.

In order to facilitate the exchange of the inking roller 16 gripping means 42 are provided on the side walls 37 of the protective shroud 22—as shown in FIG. 2, 5 and 6—, so that the protective shroud 22 can be gripped by hand and the inking roller support 14 pivoted away. In order that the pressure spring 19 should not be overstressed in the course of this operation, a projection 38 which abuts against the beads 21 and thus prevents excessive pivotable movement, is provided on the outwardly projecting side of the inking roller support 14 in the vicinity of the pivot axis 18.

Figure 7:
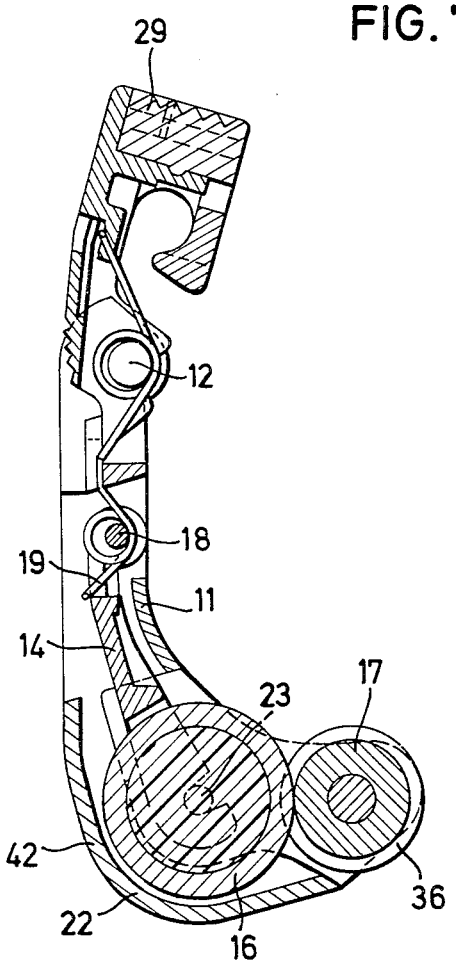
FIG. 7 is a sectional view corresponding to FIG. 1, relating to a second embodiment.

A second example of the embodiment of an inking device is shown in FIG. 7. By contrast with the embodiment shown in the previous figures, the protective shroud 22 is here not joint to the inking roller support 14 but integral with the inking pivot member 11. This protective shroud also covers the regions of the inking roller 16 facing the end of the housing 1. For this purpose the side of the inking pivot member 11 facing away from the transfer roller 17 and also from the inking roller 16 is in the form of a protective shroud 22 which partly surrounds the inking roller 16. The protective shroud 22 is provided with gripping beads 42. Upon gripping the latter, the inking pivot member 11 may be withdrawn and pivoted away. The inking roller 16 can only be exchanged after the transfer roller 17 has been removed.

In this embodiment also the complete inking device can be withdrawn, by drawing the latching clamp 29 towards the printer. The inking device can then be removed from the bolt 28.

We claim:

1. In a printing device such as labelling appliance having a printing table, a printer movably mounted with respect to the table, an ink carrier which inks printing types carried by said printer, an inking pivot member which holds said ink carrier at the free end thereof and which is pivotable against the force of a return spring, said pivot member being adapted to be pivoted out of the path of movement of the printer when the printer moves toward the printing table, the improvement comprising said ink carrier being a resilient transfer roller which is freely rotatably mounted with respect to said inking pivot member and including a dense, readily wettable surface;

an inking roller that stores ink, said inking roller being made of a finely porous material;

an inking roller support having side walls where each wall has an open-ended bearing recess which opens toward said transfer roller for freely rotatably supporting said inking roller about an axis parallel to the axis of rotation of said transfer roller, said inking roller support being pivotably supported by the inking pivot member about an axis which is parallel to and spaced between the pivot axes of the inking pivot member and the transfer roller; and a pressure spring for biasing the inking roller support so that said inking roller normally engages said transfer roller to ink the transfer roller upon relative rotation of the inking and transfer rollers where said relative rotation is due to frictional contact between the inking and transfer rollers, said inking roller being exchangeable by pivoting said inking roller support away from inking pivot member to thereby remove the inking roller out of contact with the transfer roller and thus permit the removal of the inking roller from the open-ended bearing recesses of the side walls of the inking roller support and the replacement thereof.

2. A printing device according to claim 1 where the side of the inking roller support facing away from the transfer roller is in the form of a protective shroud encompassing approximately half the inking roller.

3. A printing device according to claim 1 where the side of the inking pivot member facing away from the transfer roller is in the form of a protective shroud partly encompassing the inking roller.

4. A printing device according to claim 2, characterized in that the side walls of the protective shroud are provided with gripping beads.

5. A printing device according to claim 1 where the inking roller support is, above its pivot axis, provided with a latching projection, which interacts with a bead on a resilient abutment bridge of the inking pivot member, and enables the inking roller support to be pivoted away when substantial force is applied and retains the latter against the action of the pressure spring in its pivoted-away position.

6. A printing device according to claim 1 at approximately the level of the pivot axis the inking roller support has a projection which prevents the inking roller support from being pivoted away to an excessive extent.

7. A printing device according to claim 1 the inking roller is made up of a core of a coarsely porous material, e.g. felt, of a hollow cylindrical envelope of finely porous, sintered plastics material and two lateral discs with stub shafts.

8. A printing device according to claim 7 where the discs are pressed into the hollow cylinder of the finely porous envelope and that radially protruding shoulders, serving as abutments, are provided on the outer sides of the discs.

9. A printing device according to any one of claim 1 at least one lateral shoulder, which protrudes axially and which rolls over a curved track connected to the printer in the course of a printing operation is provided on the transfer roller.

10. A printing device according to claim 9 where curved tracks are provided on both lateral walls of the housing of the printer, the curved tracks being in alignment with two lateral, axially protruding shoulders of the transfer roller.

* * * * *